US009894969B1

(12) United States Patent
Tong

(10) Patent No.: US 9,894,969 B1
(45) Date of Patent: Feb. 20, 2018

(54) GARMENT BAG

(71) Applicant: Joy Tong, Boca Raton, FL (US)

(72) Inventor: Joy Tong, Boca Raton, FL (US)

( * ) Notice: Subject to any disclaimer, the term of this patent is extended or adjusted under 35 U.S.C. 154(b) by 0 days.

(21) Appl. No.: 15/497,225

(22) Filed: Apr. 26, 2017

(51) Int. Cl.
*A45C 3/00* (2006.01)
*A45C 13/03* (2006.01)
*A47G 25/54* (2006.01)

(52) U.S. Cl.
CPC ..... *A45C 3/004* (2013.01); *A45C 13/03* (2013.01); *A47G 25/54* (2013.01)

(58) Field of Classification Search
CPC ..... A45C 3/004; A45C 13/03; A47G 25/54
See application file for complete search history.

(56) References Cited

U.S. PATENT DOCUMENTS 2,261,291 A * 11/1941 Salavsky ..... A45C 3/004 190/113
2,626,689 A * 1/1953 Davis ..... A45C 3/004 190/113
3,433,335 A 3/1969 Spitz
4,170,282 A 10/1979 Schwartzstein
4,901,897 A 2/1990 Briggs et al.
4,953,674 A 9/1990 Landes
5,259,539 A 11/1993 Brotman
5,330,049 A * 7/1994 Bertelsen ..... A45C 3/004 190/127
2014/0008252 A1 1/2014 Grey
2015/0296947 A1* 10/2015 Berglund ..... A45C 13/03 206/279

* cited by examiner

*Primary Examiner* — Tri Mai
(74) *Attorney, Agent, or Firm* — Pai Patent & Trademark Law Firm; Chao-Chang David Pai

(57) ABSTRACT

A garment bag includes a rectangular bag having a zipper opening, a pocket flap mounted at an inner bottom side of the bag with a narrow gap defined between the pocket flap and the bag and having two windows located on two opposite lateral sides thereof, two buckle modules each including a first buckle member positioned in one respective window and a second buckle member mounted near the top of the bag and fastenable to the first buckle member to secure the bag in a folded condition for allowing the top side of the folded bag to be received in the narrow gap.

5 Claims, 5 Drawing Sheets

GARMENT BAG

BACKGROUND OF THE INVENTION

(a) Field of the Invention

The present invention relates to garment bags and more particularly to a garment bag that has means for securing the bag in a folded condition, and means for allowing the user to carry the bag conveniently by hand or on the shoulder.

(b) Description of the Prior Art

Various garment bags are known. Exemplars are seen in U.S. Pat. No. 5,259,539, U.S. Pat. No. 3,433,335, U.S. Pat. No. 4,901,897, U.S. Pat. No. 4,953,674, U.S. Pat. No. 4,170,282, and US20140008252. These garment bags commonly comprise a flexible bag body with an opening on the middle or top side, through which the user can put suits, coats or other clothes in the bag in a flat manner, allowing the bag with the clothes received inside to be folded up or rolled up. Thus, by means of a shoulder strap or carrying belt of the garment bag, the user can carry the folded garment bag by hand or on the shoulder.

However, even simple type garment bags are still complicated in structure, therefore high in cost. For a user who simply needs a simple storage, these complicated structural designs are unnecessarily cumbersome. Further, a complicated structural design makes it inconvenient to put clothes in the bag or take the stored clothes out of the bag. For example, when folding up the garment bag disclosed in U.S. Pat. No. 4,901,897 and U.S. Pat. No. 4,953,674, the user needs to fasten up the zip fastener that extends along the border area of the garment bag. It is inconvenient and takes much time to fasten up the border zip fastener. Further, when using the flexible garment bag disclosed in US20140008252 and U.S. Pat. No. 4,170,282, the user needs to roll up the bag and then fasten up the closure or fastener means so that the garment bag can be carried by hand. This design of flexible garment bag is convenient to use. However, the component parts of the closure or fastener means may be not kept in alignment for fastening after the user rolled up the garment bag.

Therefore, it is desirable to provide a simple design of garment bag, which allows the user to put in or take out garments rapidly and conveniently, and to hang the garment bag on a transverse bar in a wardrobe in an unfolded condition.

SUMMARY OF THE INVENTION

The present invention has been accomplished under the circumstances in view. It is one object of the present invention to provide a garment bag which is equipped with two buckle modules for securing the bag in a folded condition, by allowing one end of the folded bag to be received in a narrow gap inside a pocket flap at the other end of the bag.

It is another object of the present invention to provide a garment bag which is equipped with a carrying belt having two ring hangers at opposite ends thereof so that the user can carry the garment bag by hand or with a shoulder strap.

It is still another object of the present invention to provide a garment bag which has a clothes hanger buckle unit mounted in a V-shaped opening at a top side thereof so that the user can conveniently secure a clothes hanger with the loaded clothes to the clothes hanger buckle unit.

Other advantages and features of the present invention will be fully understood by reference to the following specification in conjunction with the accompanying drawings, in which like reference signs denote like components of the structure.

DETAILED DESCRIPTION OF THE PREFERRED EMBODIMENTS

Figure 1:
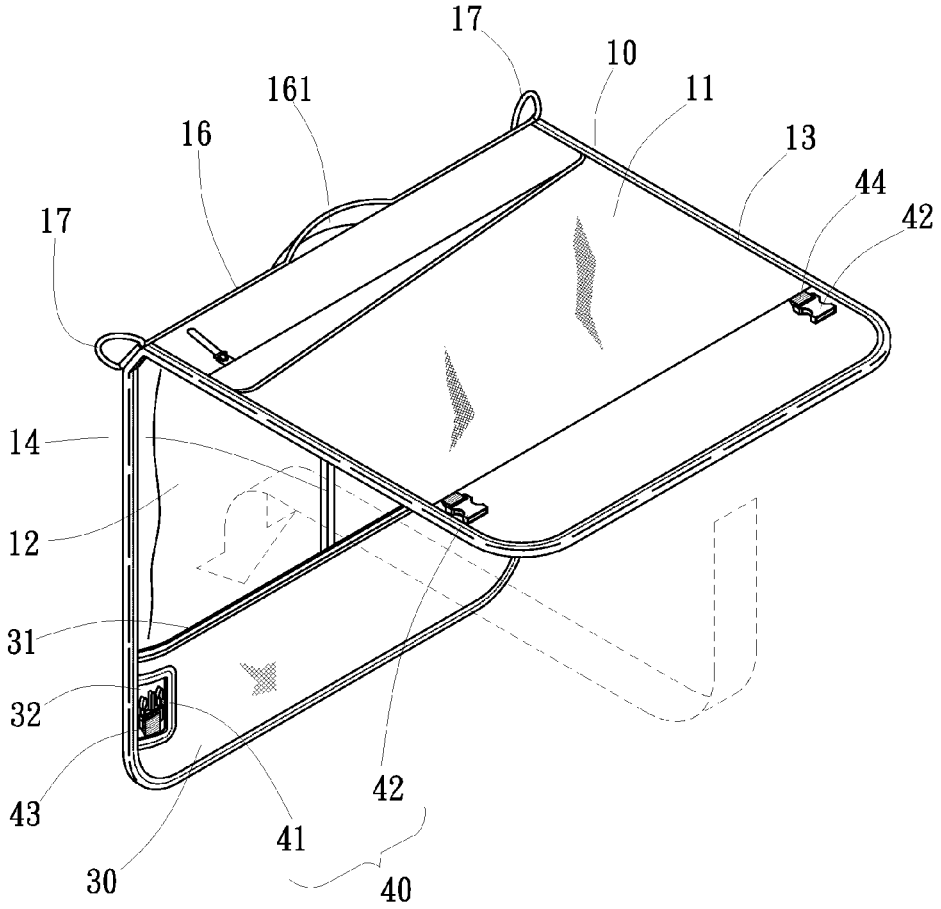
FIG. 1 is a schematic elevational view of a garment bag in accordance with the present invention.
Figure 2:
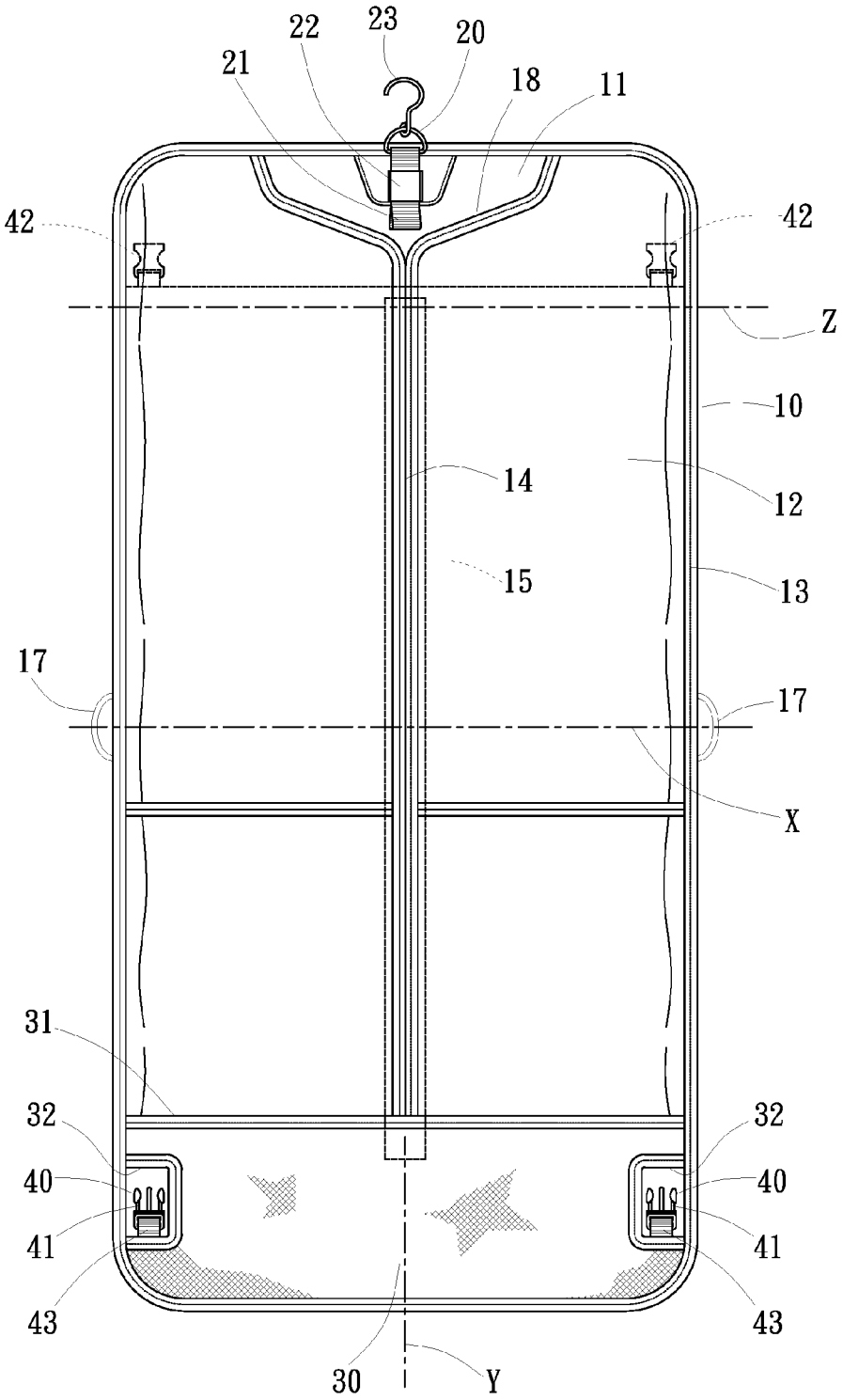
FIG. 2 is a schematic extended-out view of the inner side of the garment bag in accordance with the present invention.
Figure 3:
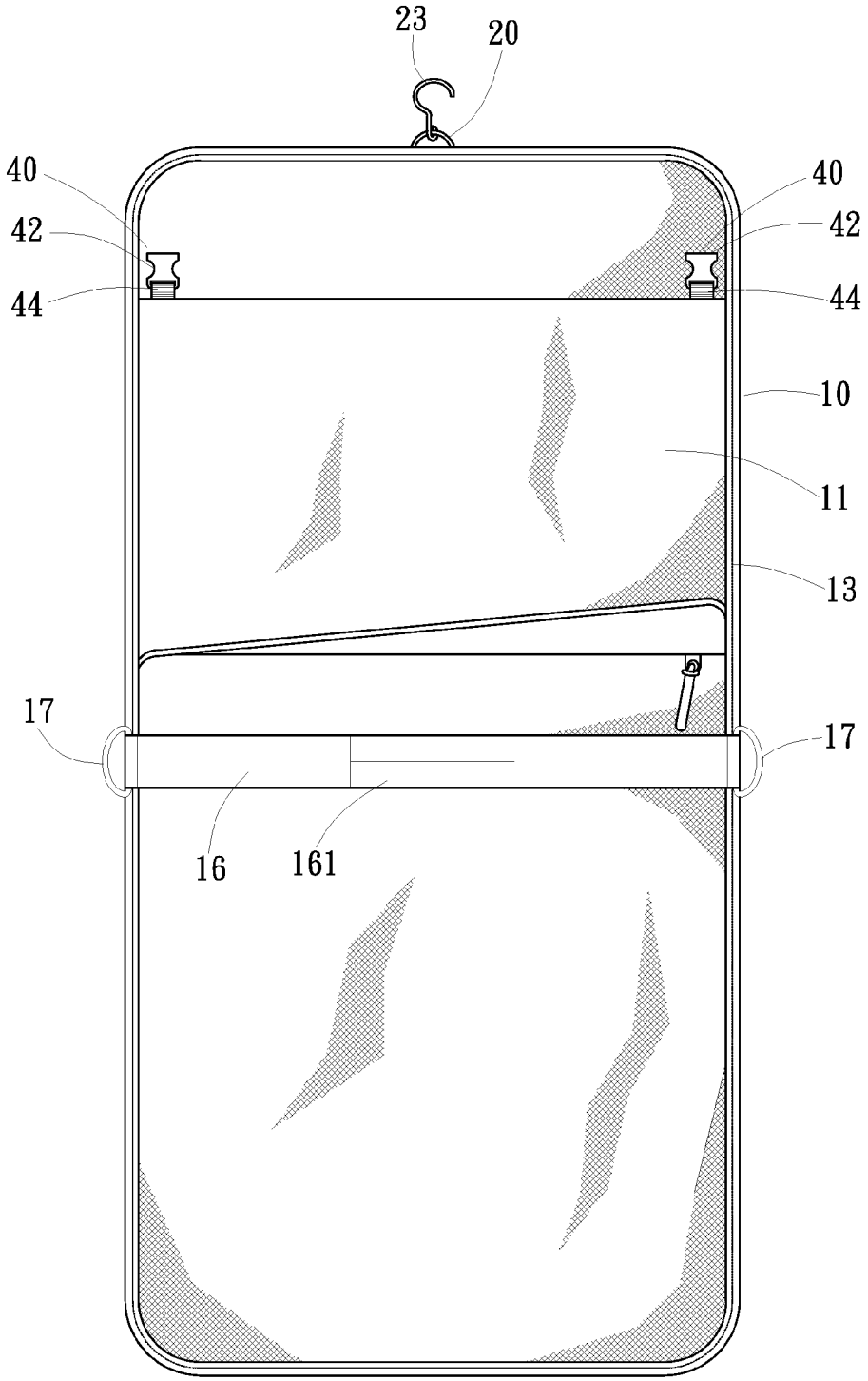
FIG. 3 is a schematic extended-out view of the outer side of the garment bag in accordance with the present invention.

Referring to FIGS. 1, 2 and 3, a garment bag in accordance with the present invention is shown for holding suits, shirts and other garments in a flat form. As illustrated, the garment bag comprises a bag 10, a clothes hanger buckle unit 20, a pocket flap 30 and two buckle modules 40.

The bag 10 is a flat, flexible rectangular container, comprising a rectangular piece of outer fabric 11, a piece of inner fabric 12 of equal dimension attached to the inner surface of the outer fabric 11 and peripherally fastened thereto with stitches 13, a zipper opening 14 located on the inner fabric 12 and extending along a longitudinal centerline Y, a zip fastener 15 adapted for closing/opening the zipper opening 14 so that clothes can be put through the zipper opening 14 into the inside of the bag 10 and held therein in a flat form, and a carrying belt 16 fastened to the outer surface of the outer fabric 11 and extended along a transverse centerline X across the longitudinal centerline Y for allowing the bag 10 to be folded up along the transverse centerline X.

The clothes hanger buckle unit 20 is adapted for securing a clothes hanger in place and also for hanging the bag 10. Further, the clothes hanger buckle unit 20 is mounted at a top side of the longitudinal centerline Y inside the outer fabric 11, comprising a clothes hanger tie belt 21, a belt buckle 22 mounted at the clothes hanger tie belt 21, and a hanging hook 23 mounted at the clothes hanger tie belt 21. The clothes hanger tie belt 21 can be inserted through the clothes hanger to be used, and then turned back, and then fastened by the belt buckle 22 into a loop to secure the clothes hanger in place. By means of the hanging hook 23, the bag 10 can be hung on a transverse bar in a wardrobe.

The pocket flap 30 is a rectangular sheet fabric, leather or plastic of equal width relative to the outer fabric 11 and the inner fabric 12. The pocket flap 30 is attached to the bottom side of the inner fabric 12 with two opposite end edges and bottom edge thereof affixed to the outer fabric 11 and the inner fabric 12 by the stitches 13 so that a narrow gap 31 is formed between the pocket flap 30 and the inner fabric 12. Further, the pocket flap 30 has two windows 32 of rectangular or other shape respectively located at two opposite lateral sides thereof in communication with the narrow gap 31. Through the window 32, the user can see the inner fabric 12.

The two buckle modules 40 each comprise a first buckle member 41, a second buckle member 42, a first mounting belt 43 having one end thereof stitched to the inner fabric 12 inside one respective window 32 of the pocket flap 30 and an opposite end thereof connected with the first buckle member 41, and a second mounting belt 44 having one end thereof stitched to the outer surface of the outer fabric 11 near a top side and an opposite end thereof connected with the second buckle member 42 to keep the second buckle member 42 in alignment with the first buckle member 41.

Figure 4:
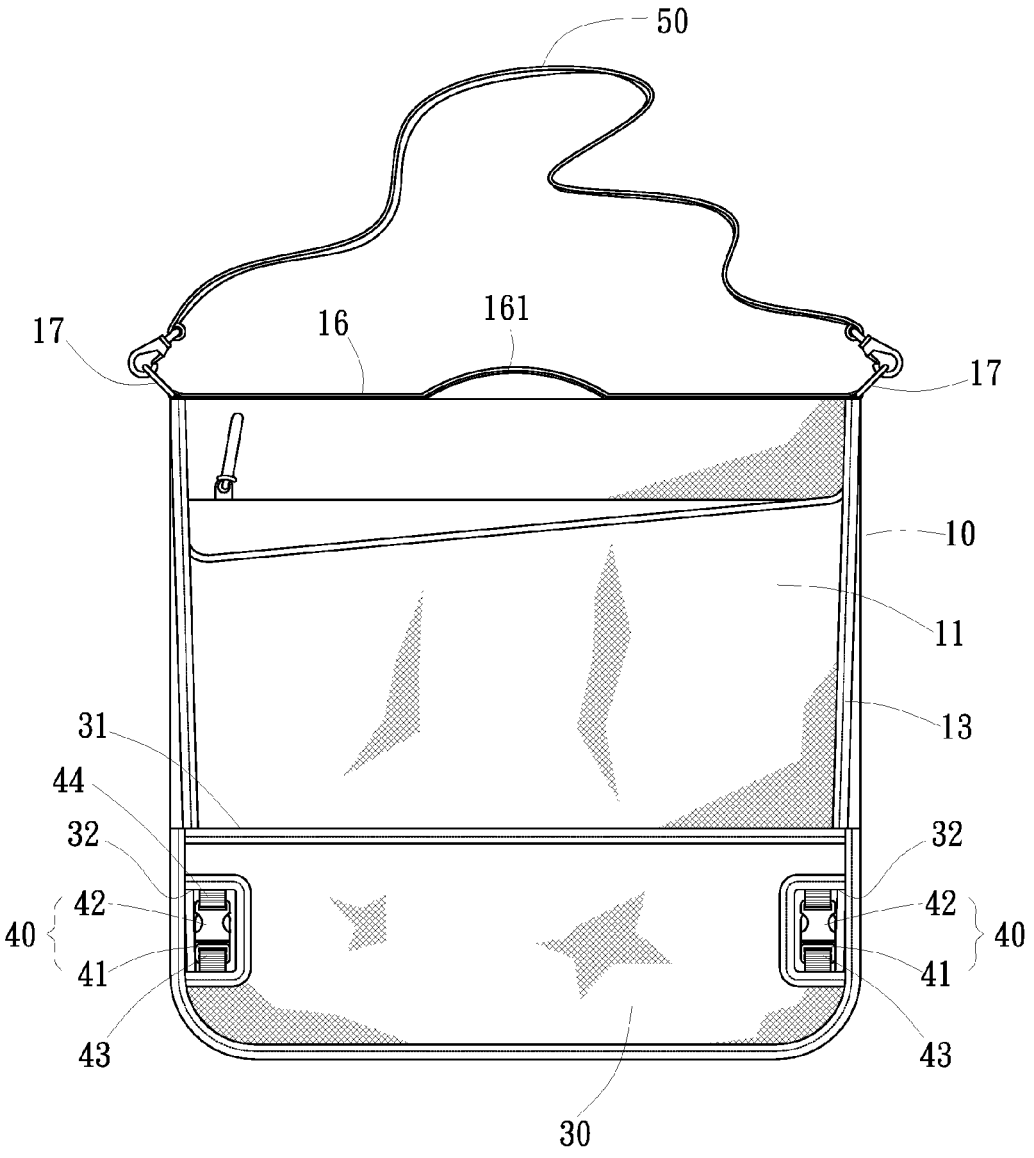
FIG. 4 is a schematic front view of the present invention, illustrating the garment bag folded up.

As illustrated in FIG. 4, the buckle module 40 is preferably a type of side release buckle wherein the first buckle member 41 is male buckle member; the second buckle member 42 is female buckle member detachably fastenable to the first buckle member 41.

As illustrated in FIG. 1 and FIG. 4, the carrying belt 16 is an elongated fabric, leather or plastic belt stitched to the outer fabric 11 with a middle part thereof separated from the outer fabric 11 to form an arched grip 161. Two ring hangers 17 are respectively fastened with the two opposite ends of the carrying belt 16 to the outer fabric 11 so that a shoulder strap 50 can be fastened to the two ring hangers 17 in a detachable manner. Thus, through the grip 161, the user can carry the garment bag by hand; through the shoulder strap 50, the user can carry the garment bag on the back.

Further, as illustrated in FIG. 2, the inner fabric 12 is configured to provide a V-shaped opening 18 at the top side of the longitudinal centerline Y to expose the inner surface of the outer fabric 11. The clothes hanger buckle unit 20 is mounted at the inner surface of the outer fabric 11 corresponding to the V-shaped opening 18, so that the user can conveniently secure a clothes hanger with the loaded clothes to the clothes hanger buckle unit.

Figure 5:
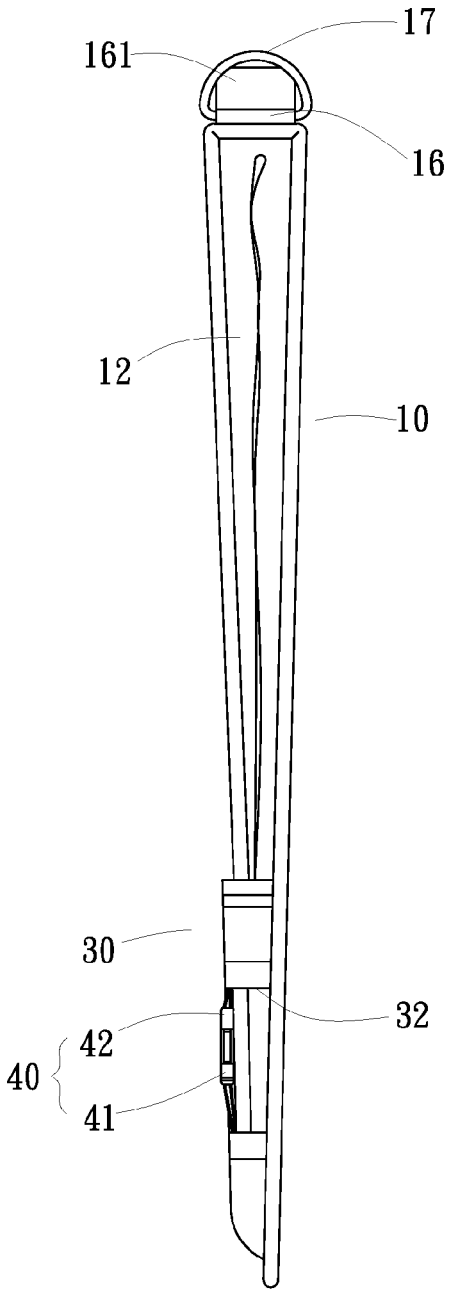
FIG. 5 is a side view of FIG. 4.

Thus, as illustrated in FIG. 1, FIG. 4 and FIG. 5, the user can fold up the bag 10 of the garment bag along the transverse centerline X, and then insert the top side of the bag 10 (i.e. the portion above the dotted transverse line Z in FIG. 2) into the narrow gap 31 between the pocket flap 30 and the inner fabric 12 to keep the two second buckle members 42 in the respective windows 32. At this time, the user can fasten the first buckle members 41 and the respective second buckle members 42 together (see FIG. 4 and FIG. 5) to hold the bag 10 in the folded condition.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A garment bag, comprising:

a bag comprising a rectangular piece of outer fabric, a piece of inner fabric attached to an inner surface of said outer fabric and peripherally fastened thereto with stitches, a zipper opening located on said inner fabric and extending along a longitudinal centerline, a zip fastener adapted for closing/opening said zipper opening, and a carrying belt fastened to an outer surface of said outer fabric and extended along a transverse centerline across said longitudinal centerline for allowing said bag to be folded up along said transverse centerline;

a pocket flap attached to a bottom side of said inner fabric with two opposite end edges and bottom edge thereof affixed to said outer fabric and said inner fabric with stitches so that a gap is formed between said pocket flap and said inner fabric for receiving an upper part of the folded said bag, said pocket flap comprising two windows respectively located at two opposite lateral sides thereof in communication with said narrow gap; and two buckle modules each comprising a first buckle member, a second buckle member detachably fastenable to said first buckle member, a first mounting belt having one end thereof stitched to said inner fabric inside one respective said window of said pocket flap and an opposite end thereof fastened with said first buckle member, and a second mounting belt having one end thereof stitched to said outer surface of said outer fabric near a top side and an opposite end thereof connected with said second buckle member to keep said second buckle member in alignment with said first buckle member.

2. The garment bag as claimed in claim 1, further comprising a clothes hanger buckle unit mounted at the said inner surface of said outer fabric at a top side of said longitudinal centerline for securing a clothes hanger in place.

3. The garment bag as claimed in claim 1, wherein said buckle modules are side release buckles; said first buckle member of each said buckle module is a male buckle member; and said second buckle member of each said buckle module is a female buckle member fastenable to the said male buckle member of the respective said first buckle member.

4. The garment bag as claimed in claim 1, wherein said carrying belt has two opposite ends thereof respectively fastened with one respective ring hanger to said outer fabric, and a middle part thereof separated from said outer fabric to form an arched grip.

5. The garment bag as claimed in claim 1, wherein said inner fabric is configured to provide a V-shaped opening at the top side of said longitudinal centerline to expose the said inner surface of said outer fabric; and said clothes hanger buckle unit is mounted at the said inner surface of said outer fabric within said V-shaped opening.

* * * * *